United States Patent [19]

Wackerbarth

[11] 4,111,758

[45] Sep. 5, 1978

[54] APPARATUS FOR THE UNIFORM DISTRIBUTION OF COMBUSTION MEDIA IN A BATTERY OF COKE OVENS

[75] Inventor: Folkard Wackerbarth, Bochum, Fed. Rep. of Germany

[73] Assignee: Dr. C. Otto & Comp. G.m.b.H., Bochum, Fed. Rep. of Germany

[21] Appl. No.: 765,889

[22] Filed: Feb. 7, 1977

[30] Foreign Application Priority Data

Feb. 7, 1976 [DE] Fed. Rep. of Germany ..... 2604871

[51] Int. Cl.[2] ..... C10B 5/12; C10B 21/06

[52] U.S. Cl. ..... 202/138; 202/142

[58] Field of Search ..... 202/138, 139, 140, 141, 202/142

[56] References Cited

U.S. PATENT DOCUMENTS

| | | | |
|---|---|---|---|
| 2,306,366 | 12/1942 | Becker | 202/142 |
| 2,334,612 | 11/1943 | Davis | 202/141 |
| 3,875,016 | 4/1975 | Schmidt-Balve et al. | 202/141 X |

*Primary Examiner*—Morris O. Wolk

*Assistant Examiner*—Arnold Turk

*Attorney, Agent, or Firm*—Thomas H. Murray

[57] ABSTRACT

Gas-flow resistance elements are incorporated in each of the rich-gas distribution lines, the lean-gas distribution ducts and the smoke-gas ducts forming part of a battery of coke ovens. The flow resistance elements are employed to insure uniform and adequate distribution of combustion media along the individual rows of heating flues of the coke oven battery. Substantially identical gas-flow resistance elements in the rich-gas distribution lines reduce the flow of rich-gas by an amount which is greater than 50 mmWG whereby, for example, a rich-gas head pressure of 120 mmWG is reduced to approximately 70 mmWG. Substantially identical gas-flow resistance elements in the lean-gas distribution branch ducts reduce the lean-gas pressure therein by an amount greater than 100 mmWG. Substantially identical gas-flow resistance elements in the smoke-gas ducts reduce the flow of smoke-gas therein by an amount corresponding to a loss of head pressure which is greater than 15 mmWG.

5 Claims, 2 Drawing Figures

Figure 1:
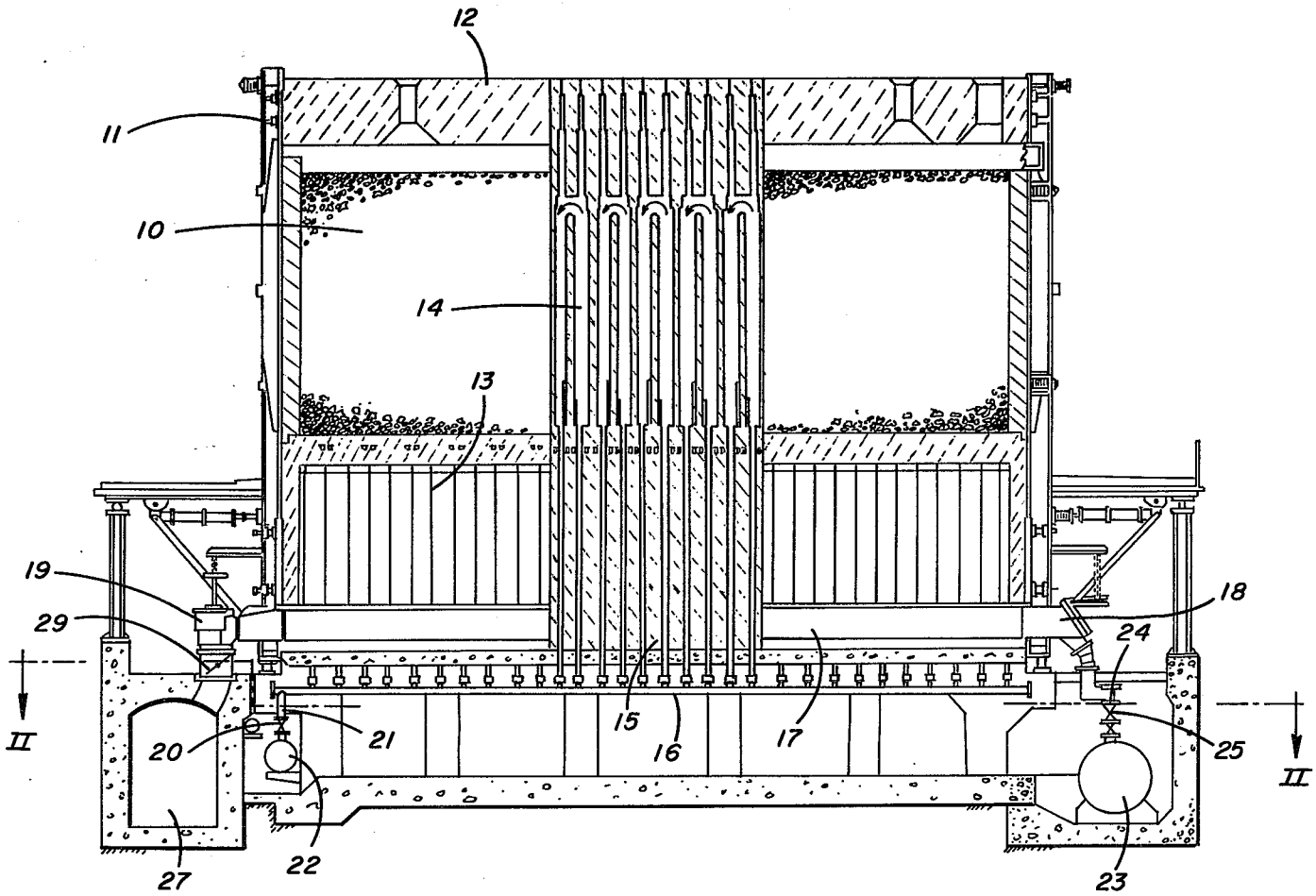

APPARATUS FOR THE UNIFORM DISTRIBUTION OF COMBUSTION MEDIA IN A BATTERY OF COKE OVENS

BACKGROUND OF THE INVENTION

This invention relates to a battery of coke ovens with regenerative heat exchange between uncombined combustion media and burnt gases; the combustion media and burnt gases flow through conduits including rich-gas distribution branch lines having substantially identical gas-flow resistance elements, lean-gas distribution branch ducts having substantially identical gas-flow resistance elements and smoke-gas ducts having substantially identical gas-flow resistance elements to insure uniform and adequate distribution of media along the individual rows of heating flues.

More specifically, the present invention relates to a battery of coke ovens with regenerative heat exchange between uncombined combustion media fed into rows of individual heating flues in the battery of coke ovens and burnt gases drawn from such heating flues wherein the heating flue rows are connected, on one hand, through nozzle ducts associated with rich-gas burners or through horizontal brick ducts extending beneath the heating flue floor to a rich-gas distribution duct extending along the battery of coke ovens, the heating flue rows being connected, on the other hand, through regenerator floor ducts and changeover valves to lean-gas distribution ducts extending along the battery of coke ovens while the regenerator floor ducts are connected through smoke-gas valves to a smoke-gas collecting duct.

It has been observed that in a battery of coke ovens wherein a substantial number of coke oven chambers extend along in a spaced-apart, side-by-side relation, that the mean temperature in the heating flues supplying heat to such coke oven chambers substantially differs from heating flue-to-heating flue along the battery. The substantial difference between the mean heating flue temperature is due to the unequal pressure of fuel gases flowing from gas distribution lines along the battery to the heating walls. These heating walls are divided into individual heating flues. The substantial differences to the mean heating flue temperatures are also due to changes to the negative pressure (draught) which increases along the battery of coke ovens and draws the burnt gases off from the regenerator floor ducts. The temperature differences from row-to-row of heating flues result in widely varying temperatures and, therefore, widely varying properties to the coke which is pushed from the oven chamber when each chamber is operated for the same coking time. Alternatively, it is necessary to employ coking times of different lengths if the coke is to attain the same final temperature in each coking chamber before the coke is pushed.

To obtain uniform operation of the rows of heating flues along the battery of coke ovens in this respect, it is necessary to grade the quantities of rich-gas and lean-gas to be supplied to the individual rows of heating flues and to adjust smoke-gas valves so that there is a greater restriction to the flow of media in regard to the heating walls situated near the chimney. Regulation of this kind represents a relatively cumbersome and awkward task. Moreover, such gradings of the built-in regulating elements apply only to a specific operating state of the coke oven chambers, i.e., a specific coking time. A change to the coking time necessitates readjusting the regulating elements which is a procedure that involves a substantial amount of time and labor.

SUMMARY OF THE INVENTION

It is an object of the present invention to provide an improved arrangement of parts for a battery of coke ovens heated by the regenerative heat exchange between uncombined combustion media and burnt gases so as to achieve approximately equal temperatures to the coke charges through approximately uniform heating by the rows of individual heating flues. Each coke charge can be pushed at the conclusion of the specific coking time without the need for adjusting the regulating elements to control the supply of the gaseous combustion media and to control the extraction of burnt gases from the rows of individual heating flues.

More specifically, according to the present invention there is provided an apparatus to insure uniform distribution of combustion media along rows of individual heating flues in a battery of coke ovens which include regenerators for heat exchange between burnt gases and uncombined combustion media, the rows of individual heating flues including burners, some of which are supplied with rich-gas through rich-gas distribution lines communicating with a rich-gas supply header extending along the battery of coke ovens, the remainder of the burners are supplied with lean-gas through lean-gas distribution branch ducts communicating with a lean-gas supply header extending along the battery of coke ovens, the rows of heating flues being connected by said regenerators through individual smoke-gas valves in smoke-gas ducts communicating with a smoke-gas collecting duct extending along the battery of coke ovens, the apparatus comprising the combination therewith of substantially identical gas-flow resistance elements in each of the rich-gas distribution branch lines, the lean-gas distribution branch ducts and the smoke-gas ducts to insure uniform and adequate distribution of combustion media along the individual rows of heating flues.

Thus, according to the present invention, in the branch lines of the gas distribution ducts leading to the rows of individual heating flues and in the regions of the smoke-gas valves there is provided an identical or substantially identical flow resistant element of such a construction that the resistance afforded thereby is of a magnitude to insure adequately uniform distribution of the combustion media along the rows of individual heating flues.

The present invention assures uniform distribution and collection of combustion media even when the distribution duct or collecting duct has a cross section which is large as compared with the sum of the cross sections of the branch lines, with respect to both distribution and collection of combustion media. The number and run distance of the individual branch lines from the beginning or end of the distribution or collecting duct is no longer a factor that heretofore had substantial affects on the pressure of the gaseous media supplied by the distribution duct or the suction applied to draw burnt gases from the branch lines. The flow rate of gases in each distribution duct or collection duct has substantially the same value for all similar ducts. When flow resistance elements are incorporated in the branch lines, higher values to the total pressures are necessary for supplying the gas and for supplying suction to extract the burnt gases. Rich-gas as well as lean-gas are normally supplied through compressors and the gases must, in any event, be expanded before introduction into the flues of the coke oven. At the present time, it is generally required in the interest of environmental protection and the height of chimney means, that the magnitude of the negative pressure is sufficient to extract the burnt gases and more than adequate to overcome the flow resistances which are necessary according to the present invention.

In regard to the aforementioned flow resistance elements, a loss of head pressure from approximately 120 mmWG to 70 mmWG has been found advantageous for the loss of head pressure between the rich-gas distribution headers and the rich-gas distribution branch lines used in an underjet oven. A head pressure of 70 mmWG in the nozzle pipes for rich-gas is adequate for achieving effective regulation by means of the nozzles which lead to the individual rich-gas burners in the heating flues.

A loss of head pressure in excess of 100 mmWG is recommended according to the present invention between the lean-gas distribution header and the regenerator floor ducts which are biased by changeover valves used in regenerative heating half-cycles.

The flow resistance elements resulting in a minimum loss of head pressure of 15 mmWG should be installed in the regions of the smoke-gas valve between the regenerator floor ducts and the smoke-gas collecting duct.

Figure 2:
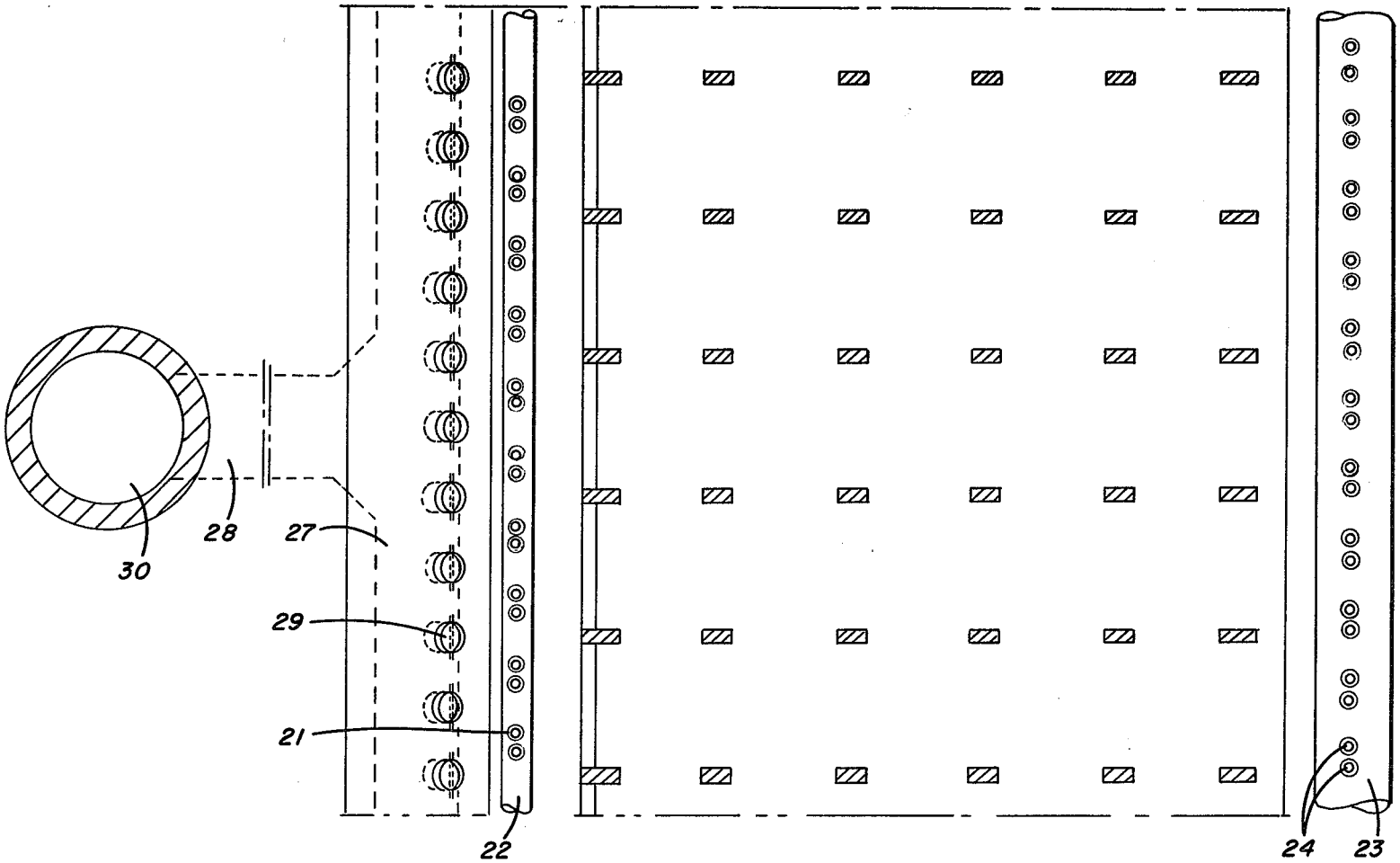

These features and advantages of the present invention, as well as others, will be more fully understood when the following description is read in light of the accompanying drawings, and in which:

FIG. 1 is an elevational view illustrating different sections through an underjet-type of regeneratively-heated coke oven chamber forming one of a battery of coke ovens; and FIG. 2 is a sectional view taken along line II—II of FIG. 1.

In FIG. 1, there is illustrated one of a plurality of coke oven chambers 10 with side walls therein heated by rows of twin-heating flues 14. The twin-heating flues shown in FIG. 1 are of the twin-flue type, each consisting of upgoing heating flues and downgoing heating flues formed by continuous and discontinuous cross-walls extending between the heating walls. Tie-bar stands 11 support the oven masonry which includes an oven roof 12. The coke oven battery further includes regenerators 13 which are divided into individual cells. The twin-heating flues include rich-gas burners and burners for lean-gas. The rich-gas burners receive rich-gas from a nozzle pipe 16. The rich-gas is supplied by vertical ducts 15 extending through regenerator bulkheads to the burners in the heating flues. Air and lean-gas are supplied through the regenerator floor ducts 17. The air and lean-gas flow through the regenerators for regenerative heat exchange and then through ducts in the floor of the heating flues into lean-gas burner openings communicating with the heating flues. Air vents 18 are actuated by a changeover winch at one end of the duct 17. A smoke-gas valve 19 at the other end of each duct communicates with a smoke-gas header.

The nozzle pipes 16 for rich-gas are connected by changeover valve 20 and flow resistance elements 21 to a rich-gas distribution header 22 which extends along the battery of coke ovens. Lean-gas is fed from a lean-gas distribution header 23 which also extends along the battery of coke ovens. The lean-gas is discharged from header 23 through changeover valve 25 and flow resistance elements 24 into the floor ducts 17 beneath the regenerators. These ducts carry lean-gas in an alternative pattern for regenerative heating of the coke ovens. The burnt gases discharged from the rows of twin-heating flues flow into a waste heat duct 27 after passing through a smoke-gas valve 19 and flow resistance element 29. The smoke-gas valve and flow resistance elements communicate with a duct extending between the floor ducts 17 and the waste heat duct 27. The waste heat is extracted into a chimney 30 from several sections of duct 27 through duct 28 which is shown in FIG. 2. Thus, as clearly shown in FIG. 2 and in accordance with the present invention, the rich-gas supplied from header 22 is subjected to one of the substantially identical flow resistance elements 21 as the rich-gas passes into the individual branch lines for the rows of heating flues. The lean-gas supplied by header 23 flows through substantially identical gas-flow resistance elements 24 communicating with the individual branch lines which feed the lean-gas to the regenerator floor duct 17; and lastly, according to the present invention, substantially identical flow resistance elements 29 are provided in the ducts downstream of the smoke-gas valves for reducing the flow of smoke-gases from the smoke-gas branch lines into the smoke-gas waste heat duct 27. As described hereinbefore, the flow resistance elements 21 in the branch lines for rich-gas provide a loss of head pressure which is greater than 50 mmWG. The openings of these flow resistance elements are dimensioned so that a rich-gas head pressure is reduced from approximately 120 mmWG in the rich-gas header 22 to about 70 mmWG pressure of rich-gas in the distribution ducts 16. Flow resistance elements 24 in the branch lines from the lean-gas distribution header are located preferably in the region of the changeover valve 25 and reduce the pressure of the lean-gas by an amount which is greater than 100 mmWG. The flow resistance elements 29 which are substantially identical and located in the regions of the smoke-gas valve 27 provide a loss of head pressure which is greater than 15 mmWG.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus to insure uniform distribution of combustion media into and from rows of individual heating flues in a battery of coke ovens which include regenerators for heat exchange between uncombined combustion media and burnt gases, the rows of heating flues including burners, some of which are supplied with rich-gas through rich-gas distribution branch lines communicating with a rich-gas supply header extending along the battery of coke ovens, the remaining burners are supplied with lean-gas through lean-gas distribution branch ducts communicating with a lean-gas supply header extending along the battery of coke ovens, valve means to control the supply of lean-gas by said lean-gas supply header, valve means to control the supply of rich-gas by said rich-gas supply header, the rows of heating flues being connected by said regenerators through individual smoke-gas valves in smoke-gas ducts communicating with a smoke-gas collecting duct extending along the battery of coke ovens, said apparatus comprising the combination therewith of substantially identical rich-gas flow resistance elements in each of said rich-gas distribution branch lines, substantially identical lean-gas flow resistance elements in each of said lean-gas distribution branch ducts and substantially identical smoke-gas flow resistance elements in each of said smoke-gas ducts to insure uniform, adequate distribution of combustion media into and from the individual rows of heating flues.

2. The apparatus according to claim 1 wherein said flow resistance elements in each of said rich-gas distribution lines reduce the flow of rich-gas therein by an amount corresponding to a loss of head pressure greater than 50 mmWG.

3. The apparatus according to claim 1 wherein said flow resistance elements in each of said rich-gas distribution lines reduce a rich-gas head pressure of 120 mmWG in said rich-gas supply header to a head pressure of approximately 70 mmWG in said rich-gas distribution lines.

4. The apparatus according to claim 1 wherein said flow resistance elements in each of said lean-gas distribution branch ducts are disposed in the region of changeover valves for regenerative heating control, and said elements reduce the flow of lean-gas therein by an amount corresponding to a loss of head pressure greater than 100 mmWG.

5. The apparatus according to claim 1 wherein said flow resistance elements in said smoke-gas ducts reduce the flow of smoke-gas by an amount corresponding to a loss of head pressure which is greater than 15 mmWG.

* * * * *